US005783784A

United States Patent [19]

Durand

[11] Patent Number: 5,783,784

[45] Date of Patent: Jul. 21, 1998

[54] DIFFERENTIAL REFLECTOMETERY FOR POSITION REFERENCE IN AN ELEVATOR SYSTEM

[75] Inventor: Christophe Durand, Gien, France

[73] Assignee: Otis Elevator Company, Farmington, Conn.

[21] Appl. No.: 752,361

[22] Filed: Nov. 19, 1996

[51] Int. Cl.[6] ..... B66B 1/34

[52] U.S. Cl. ..... 187/394; 187/282

[58] Field of Search ..... 187/283, 282, 187/394, 391

[56] References Cited

U.S. PATENT DOCUMENTS

| | | | |
|---|---|---|---|
| 3,486,640 | 12/1969 | Lemelson | 187/394 |
| 4,019,606 | 4/1977 | Caputo et al. | 187/29 R |
| 4,134,476 | 1/1979 | Zolnerovich, Jr. et al. | 187/29 R |
| 4,991,693 | 2/1991 | Stern et al. | 187/111 |
| 5,509,505 | 4/1996 | Steger et al. | 187/394 |
| 5,682,024 | 10/1997 | Koopman, Jr. et al. | 187/394 |

FOREIGN PATENT DOCUMENTS

| | | | |
|---|---|---|---|
| 1-294180 | 11/1989 | Japan | 187/394 |

*Primary Examiner*—Robert Nappi

[57] ABSTRACT

An apparatus for determining if an elevator car is level with respect to a landing in a hoistway comprises a transceiver for transmitting a signal, a first reflector having a varying reflectance between a maximum reflectance end and a minimum reflectance end, a second reflector having a varying reflectance between a maximum reflectance end and a minimum reflectance end, and a processor. The first reflector transmits a first reflected signal in response to the signal transmitted by the transceiver and the second reflector transmits a second reflected signal in response to the signal transmitted by the transceiver. The first reflector and the second reflector are adjacently aligned such that the maximum reflectance end of the first reflector is adjacent to the minimum reflectance end of the second reflector, and the minimum reflectance end of the first reflector is adjacent to the maximum reflectance end of the second reflector. The processor determines if the elevator car is level with respect to the landing in response to the first and second reflected signals.

7 Claims, 3 Drawing Sheets

DIFFERENTIAL REFLECTOMETERY FOR POSITION REFERENCE IN AN ELEVATOR SYSTEM

TECHNICAL FIELD

The present invention relates generally to elevators and, in particular, relates to position reference in an elevator system.

BACKGROUND OF THE INVENTION

To stop an elevator smoothly and level with a sill, an elevator system must know when to initiate a stop, when to go into a leveling mode of operation, and when to begin opening the landing doors. The elevator doors must not be opened when the elevator car is not within the door zone. It is therefore necessary to know the exact location of the elevator car. As a consequence, elevator position devices are used to monitor elevator car position.

One existing elevator position device includes steel bars, vanes or magnets attached to a floating steel tape, running the length of the hoistway, and a hoistway position reader box mounted on the car which are used to monitor the car position. The steel bars, vanes or magnets are located on the steel tape with respect to their corresponding landing sills to mark the approximate distance from the door zone. The reader box contains sensors that sense the location of each steel bar, vane or magnet as the car travels up and down the hoistway such that the elevator system may determine if the elevator car is level with respect to a particular landing in the hoistway.

Other techniques for determining if an elevator car is level with respect to the landing are sought, and it is to this end that the present invention is directed.

DISCLOSURE OF THE INVENTION

It is an object of the present invention to provide improved detection of a landing in an elevator hoistway.

According to the present invention, an apparatus for determining if an elevator car is level with respect to a landing in a hoistway comprises a transceiver for transmitting a signal, a first reflector having a varying reflectance between a maximum reflectance end and a minimum reflectance end, a second reflector having a varying reflectance between a maximum reflectance end and a minimum reflectance end, and a processor. The first reflector transmits a first reflected signal in response to the signal transmitted by the transceiver and the second reflector transmits a second reflected signal in response to the signal transmitted by the transceiver. The first reflector and the second reflector are adjacently aligned such that the maximum reflectance end of the first reflector is adjacent to the minimum reflectance end of the second reflector, and the minimum reflectance end of the first reflector is adjacent to the maximum reflectance end of the second reflector. The processor determines if the elevator car is level with respect to the landing in response to the first and second reflected signals.

BEST MODE FOR CARRYING OUT THE INVENTION

Figure 1:
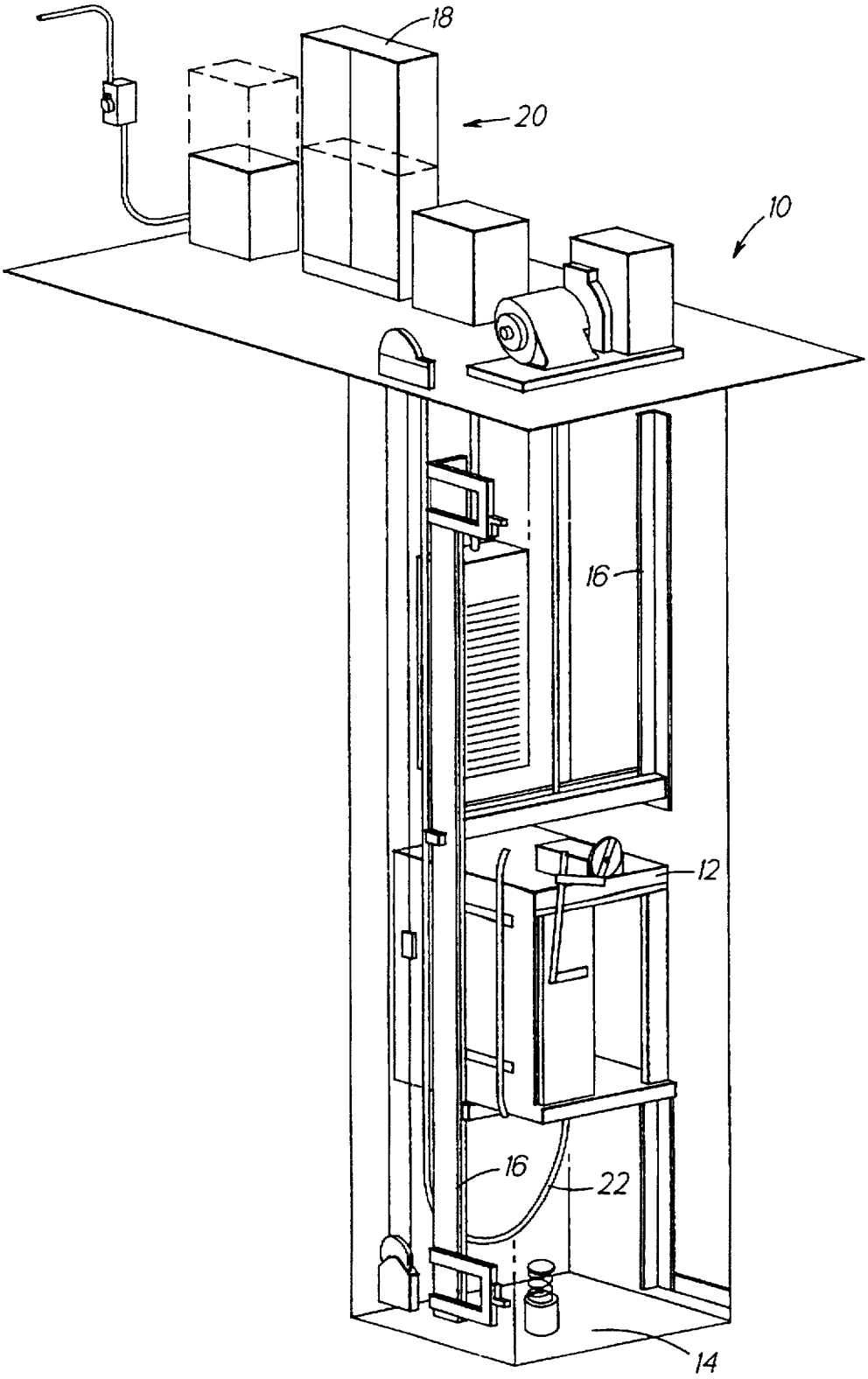
FIG. 1 is a perspective view of an elevator system in a building.

Referring to FIG. 1, an elevator system 10 in a building is shown. An elevator car 12 is disposed in a hoistway 14 such that the elevator car 12 travels in a longitudinal direction along elevator guide rails 16 disposed in the hoistway 14. An elevator controller 18 is disposed in a machine room 20 which monitors and provides system control of the elevator system 10. A traveling cable 22 is used to provide an electrical connection between the elevator controller 16 and electrical equipment in the hoistway 14. Of course, it should be realized that the present invention can be used in conjunction with other elevator systems including hydraulic and linear motor systems, among others.

Figure 2:
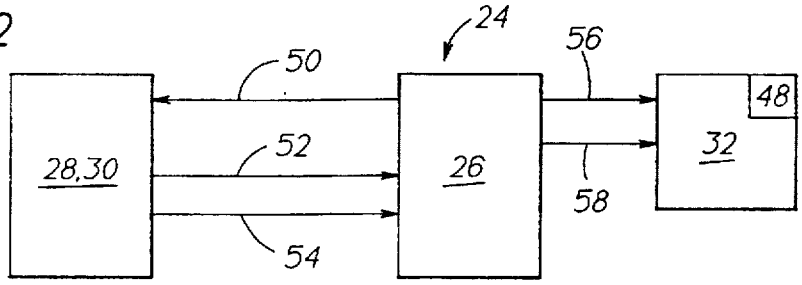
FIG. 2 is a simplified block diagram illustrating an apparatus in accordance with the present invention.

Referring to FIG. 2, an elevator position apparatus 24 according to the present invention is used in conjunction with the elevator system 10 to accurately determine the position of the elevator car 12 in the hoistway 14. The elevator position apparatus 24 includes a transceiver 26, a first reflector 28, a second reflector 30, and a processor 32 for determining if the elevator car is level with respect to a landing 46 (shown in FIG. 4).

The transceiver 26 is a device which transmits and receives an energy signal such that the intensity of the received signal may be measured. For example, the transceiver 26 comprises an emitter and a sensor. The emitter may be any radiation emitting device; for example, an infrared emitter that is modulated so that its radiated energy is distinguishable from background radiation of the surroundings. In one embodiment, the emitter is a conventional LED. The sensor is any device that is sensitive to the radiation of the emitter; yet preferably adapted to be insensitive to radiation other than that from the emitter. For example, the detector may be a photodiode or phototransistor which is designed to pass signals at the emitter modulation frequency and wavelength. In an alternate embodiment, the sensor comprises a bandpass filter so that the transceiver is insensitive to radiation other than radiation emitted from the transceiver.

The transceiver 26 transmits either at least one signal and detects at least two signals. Accordingly, the transceiver 26 comprises at least one emitter and either one sensor with the capability of receiving two signals or two discrete sensors. In one embodiment, the transceiver transmits two signals and received two signals. In one embodiment, the transceiver 26 is disposed on the elevator car 12.

Figure 3:
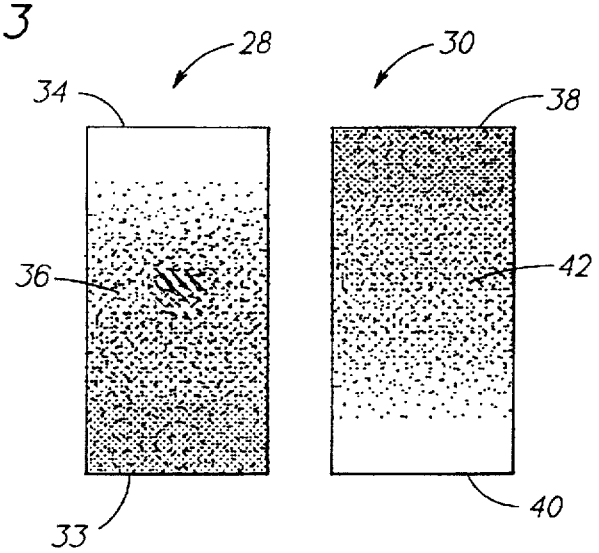
FIG. 3 is a front view of a first reflector and a second reflector.

Referring to FIGS. 2 and 3, the first reflector 28 has a maximum reflectance end 34, a minimum reflectance end 33 and a varying reflectance 36 between the two ends. Likewise, the second reflector 30 has a maximum reflectance end 40, a minimum reflectance end 38 and a varying reflectance 42 between the two ends. In one embodiment, each varying reflectance 36, 42 varies linearly between the maximum and minimum reflectance ends.

The first reflector 28 and the second reflector 30 are adjacently aligned such that the maximum reflectance end 34 of the first reflector 28 is adjacent to the minimum reflectance end 38 of the second reflector 30. The minimum reflectance end 33 of the first reflector 28 is adjacent to the maximum reflectance end 40 of the second reflector 30. In one embodiment, the first and second reflectors 28, 30 are disposed on a hoistway wall 44 proximate to the landing 46 (shown in FIG. 4). The reflectors 28, 30 are aligned such that the reflectance varies in the direction of elevator travel. Moreover, the reflectors 28, 30 and the transceiver 26 are aligned such that the transceiver 26 detects the reflected signal from the reflectors 28, 30. However, the reflectors do not need to be precisely placed with respect to the landing in the direction of elevator travel because a compensation routine may be utilized by the processor 32 as is explained herein below.

Referring to FIG. 2, the processor 32 is used for determining if the elevator car 12 is level with respect to the landing 46. In one embodiment, the processor comprises a memory 48 for storing data and software. The software is embedded in the memory using methods known to those skilled in the art and is used to determined if the elevator car 12 is level with respect to the landing 46 as is explained below. In an alternative embodiment, the processor 32 comprises hardware for determining if the elevator car 12 is level with respect to the landing 46. The processor 32, for example, may be implemented in the elevator controller 22. The implementation of either the software or the hardware of the processor 32 should be known to those of ordinary skill in the art in light of the instant specification.

Figure 5:
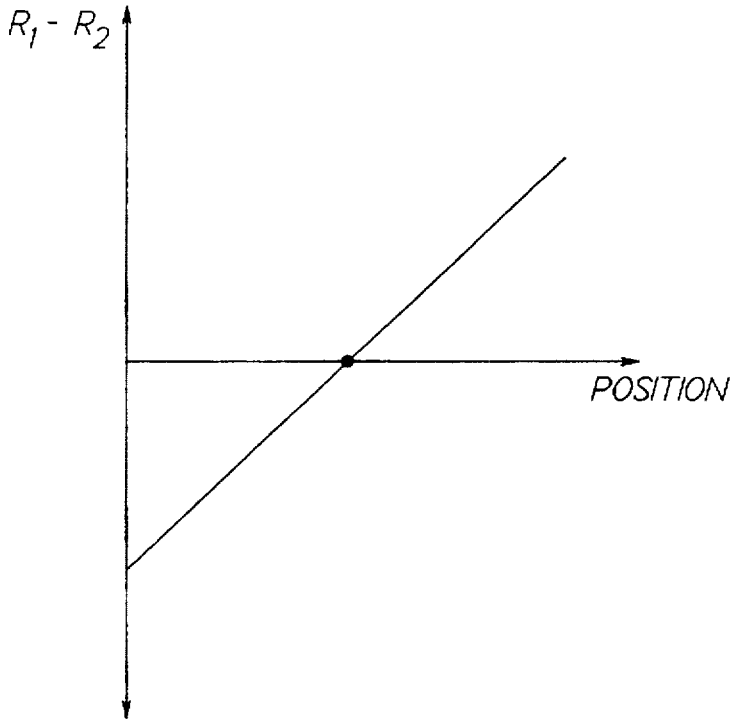
FIG. 5 is a graphical illustration of a difference of two reflected signals versus position in accordance with the present invention.
Figure 4:
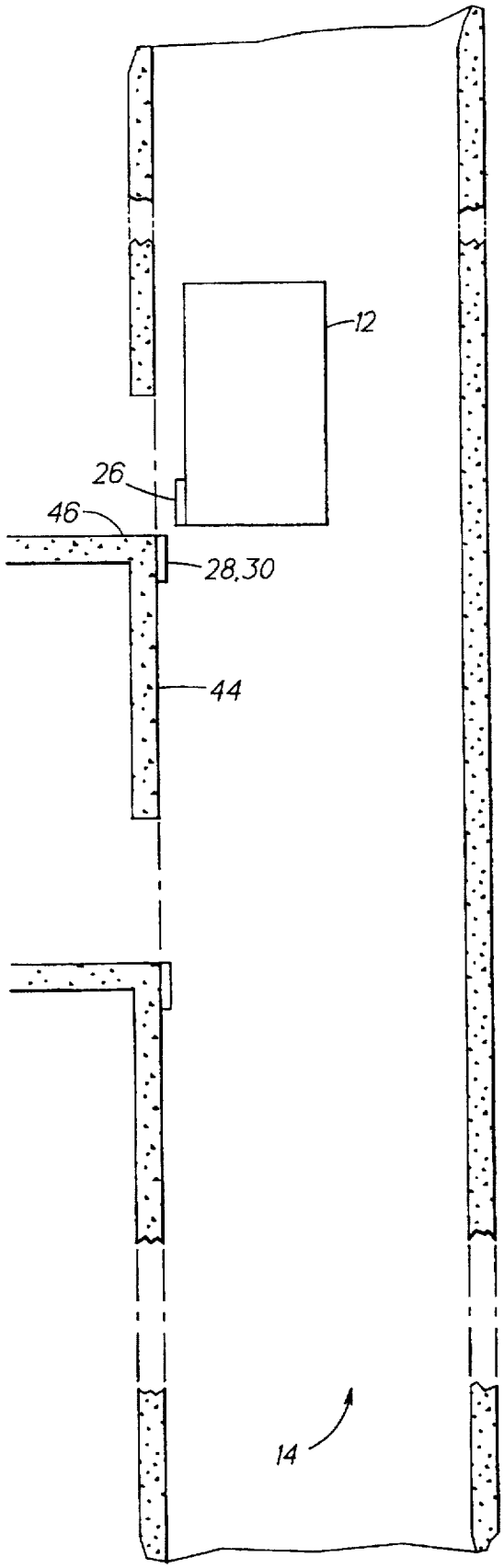
FIG. 4 is a side view of an elevator car in a hoistway incorporating a preferred embodiment of the present invention.

Referring to FIGS. 4 and 5, an illustrated embodiment of the present invention operates as follows. As the elevator car 12 travels in the hoistway 14 and approaches the landing 46, the processor 32 causes the transceiver 26 to transmit a detection signal 50. In one embodiment, the transceiver 26 transmits the detection signal 50 continuously and in another embodiment the transceiver 26 transmits the detection signal 50 only as the elevator car 12 is in the door zone. In the latter embodiment, an approximate position transducer such as, but not limited to, a governor shaft encoder or a motor shaft encoder may be used to provided an approximate position signal to the processor. These types of transducers are well known to one of ordinary skill in the art. The processor uses the approximate position signal to determine if the elevator car is near the landing, i.e., in the door zone.

As the elevator car 12 is approximately level with the landing 46, the detection signal 50 transmitted by the transceiver 26 is reflected by the first and the second reflectors 28, 30 such that a first and a second reflected signal 52, 54 is received by the transceiver 26. The transceiver 26 in turn transmits a first level signal 56 to the processor 32 in response to the first reflected signal 52 and a second level signal 58 to the processor 32 in response to the second reflected signal 54. The value of the first and second level signals 56, 58 vary according to the intensity of the first and second reflected signals 52, 54. The intensity of the first and second reflected signals 52, 54 vary according to the variable reflectance 36, 42 of the reflectors 28, 30 and, thus, according to the position of the transceiver 26 with respect to the first and second reflectors 28, 30. For example, a reflected signal from the maximum reflectance end has a higher intensity than a reflected signal from the minimum reflectance end. Moreover, if the maximum reflective end 34 of the first reflector 28 and the minimum reflective end 38 of the second reflector 42 are positioned proximate to the elevator car 12 then the first reflected signal 52 will vary from high intensity to low intensity and the second reflected signal 54 will vary from low intensity to high intensity as the elevator car 12 approaches the landing 46.

The processor 32 compares both reflected signals 52, 54 to determine the intensity of each signal. The processor 32 determines, in one embodiment, that the elevator car 12 is level with the landing 46 if both of the reflected signals 52, 54 are of equal intensity. For example, the processor 32 determines that the elevator car 12 is level with the landing 46 if the intensity of the first reflected signal 52 minus the intensity of the second reflective 54 signal equals zero.

In another embodiment, a compensation table, is stored in the memory 48 and used by the processor 32. The compensation table allows for various placement of the reflectors 28, 30. A value of the difference of first and second level signals as the elevator car is level with respect to each landing in the hoistway is stored in the compensation table. Once the table is completing during a calibration run, it may be used as a look up table to provide compensation during normal elevator operation. During normal operation, the value which corresponds to the landing is used to level the elevator car with respect to that particular landing. For example, the processor 32 determines that the elevator car 12 is level with a first landing if the intensity of the first reflected signal 52 minus the intensity of the second reflective 54 signal equals a value stored in the compensation table for the first landing.

Various changes to the above description may be made without departing from the spirit and scope of the present invention as would be obvious to one of ordinary skill in the art of the present invention.

What is claimed is:

1. An apparatus for determining if an elevator car is level with respect to a landing in a hoistway, said apparatus comprising:

a transceiver for transmitting a detection signal;

a first reflector having a varying reflectance between a maximum reflectance end and a minimum reflectance end, said first reflector transmitting a first reflected signal in response to the detection signal transmitted by said transceiver, said transceiver providing a first level signal in response to the first reflected signal;

a second reflector having a varying reflectance between a maximum reflectance end and a minimum reflectance end, said second reflector transmitting a second reflected signal in response to the detection signal transmitted by said transceiver, said transceiver providing a second level signal in response to the second reflected signal;

wherein said first reflector and said second reflector are adjacently aligned such that the maximum reflectance end of said first reflector is adjacent to the minimum reflectance end of said second reflector, and the minimum reflectance end of said first reflector is adjacent to the maximum reflectance end of said second reflector; and a processor for determining if the elevator car is level with respect to the landing in response to the first and second level signals.

2. The apparatus for determining if the elevator car is level with respect to the landing in the hoistway as recited in claim 1 wherein said first and second reflectors are disposed on a hoistway wall.

3. The apparatus for determining if the elevator car is level with respect to the landing in the hoistway as recited in claim 1 wherein said transceiver is disposed on the elevator car.

4. The apparatus for determining if the elevator car is level with respect to the landing in the hoistway as recited in claim 1 wherein the varying reflectance of said first and second reflectors varies linearly between the maximum reflectance end and the minimum reflectance end.

5. The apparatus for determining if the elevator car is level with respect to the landing in the hoistway as recited in claim 1 wherein said processor determines if the elevator car is level with respect to the landing by comparing the first and second level signals.

6. The apparatus for determining if the elevator car is level with respect to the landing in the hoistway as recited in claim 5 wherein said processor determines that the elevator car is level with respect to the landing if the first and second level signals have equal values.

7. The apparatus for determining if the elevator car is level with respect to the landing in the hoistway as recited in claim 5 wherein said processor determines that the elevator car is level with respect to the landing if a difference of the first and second level signals is equal to a value in a compensation table which corresponds to the landing.

* * * * *